US006839532B2

(12) United States Patent
Hoashi

(10) Patent No.: US 6,839,532 B2
(45) Date of Patent: Jan. 4, 2005

(54) IMAGE FORMING APPARATUS WITH IMPROVED CONVEYING UNIT POSITIONING

(75) Inventor: Shigeru Hoashi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/305,942

(22) Filed: Nov. 29, 2002

(65) Prior Publication Data

US 2003/0103780 A1 Jun. 5, 2003

(30) Foreign Application Priority Data

Dec. 3, 2001 (JP) ..... 2001-369244

(51) Int. Cl.[7] ..... G03G 15/00
(52) U.S. Cl. ..... 399/167
(58) Field of Search ..... 399/167, 66, 121, 399/297

(56) References Cited

U.S. PATENT DOCUMENTS 6,473,580 B1 * 10/2002 Inomata ..... 399/167

FOREIGN PATENT DOCUMENTS

JP 8-314290 * 11/1996
JP 2000187399 A * 7/2000 ..... G03G/15/16
JP 2002-2287455 * 10/2002

* cited by examiner

*Primary Examiner*—Quana Grainger
(74) *Attorney, Agent, or Firm*—Fitzpatrick, Cella, Harper & Scinto

(57) ABSTRACT

The image forming apparatus includes a conveying unit having a conveying member and a first transmitting portion and a driving frame for supporting the second transmitting portion, wherein the conveying unit is mountable to or removable from a body of the apparatus and when mounted, the first transmitting portion engages with the second transmitting portion and the driving frame has a positioning portion for positioning the conveying unit. By the above virtue of the image forming apparatus, the positioning accuracy of the conveying unit is improved and brings a high-quality color image.

8 Claims, 13 Drawing Sheets

IMAGE FORMING APPARATUS WITH IMPROVED CONVEYING UNIT POSITIONING

BACKGROUND OF THE INVENTION

1. Field of the Invention

The present invention relates to an image forming apparatus for a printer and a copying machine, particularly to a color-image forming apparatus in which toner images of a plurality of colors are borne and conveyed.

2. Description of Related Art

The demand for an image forming apparatus capable of forming a color image (hereafter referred to as a color-image forming apparatus) for a color copying machine and a color printer has increased in recent years among image forming apparatuses for respectively forming an image in accordance with an electronic photographing system. As this type of the color-image forming apparatus, an apparatus is expected which can achieve such six items as (1) low running cost, (2) small space, (3) low power, (4) high image quality, (5) high speed, and (6) improvement of operability.

Therefore, to provide a high-quality color image at a high speed while simplifying operability, a system is used which forms an image by arranging four process cartridges for four colors such as yellow, magenta, cyan, and black respectively provided with a photosensitive member drum in parallel.

Moreover, to improve operability, a process cartridge system has been used so far which integrates a photosensitive member drum, charging device, and developing device into a cartridge so that the cartridge is detachably mounted to the body of an image forming apparatus. By using the above cartridge system, operability is further improved and a user can easily maintain a photosensitive member drum and process means (charging device and developing device) working on the photosensitive member drum.

Moreover, similarly to the above, in the case of an image forming apparatus of temporarily transferring toner images to an intermediate transferring body and then simultaneously transferring toner images of a plurality of colors to a transferring material, the intermediate transferring body is also constituted as a unit so that the intermediate-transferring-body unit is removable from the body of the image forming apparatus and operability and maintainability are improved.

In the case of the above conventional image forming apparatus, however, because process cartridges of four colors and the intermediate-transferring-body unit are made removable from the body of the image forming apparatus by also considering operability, the configuration of the body of the image forming apparatus becomes complex. Therefore, there is deterioration of the positional accuracies of the process cartridges and intermediate-transferring-body unit.

Particularly, a stable accuracy free from fluctuation is requested for the positional accuracy between the photosensitive member drum of the process cartridges of four colors and the intermediate transferring body (intermediate transferring belt) of the intermediate-transferring-body unit in order to realize a high accuracy and a high-image quality. However, because the photosensitive member drum and the intermediate transferring body are constituted so as to be removable from the body of the image forming apparatus, the number of components set between the photosensitive member drum and the intermediate transferring body increases and thereby, dimensional errors of the set components are accumulated and the positional accuracy between both tends to be deteriorated.

On the other hand, at the time of removing a process cartridge while a photosensitive drum contacts an intermediate transferring body from the body of an image forming apparatus, it is necessary to once separate an intermediate transferring body 309 from a photosensitive member drum as shown in FIG. 13. Therefore, an image forming apparatus is provided with a mechanism for contacting with or separating from an intermediate-transferring-body unit.

In this case, to simultaneously realize the contacting/separating function of the contacting/separating mechanism of the intermediate-transferring-body unit 309 and the removing configuration from the body of the image forming apparatus, it is necessary to position the intermediate-transferring-body unit 309 to the body of the image forming apparatus at a portion other than the center of a driving coupling 324 set to a body driving unit for driving the intermediate-transferring-body unit 309.

However, when a positional error occurs between the center of the driving coupling 324 of the body driving unit and the center of a coupling 327 of the intermediate-transferring-body unit 309, if the intermediate-transferring-body unit 309 is driving-connected to the body driving unit while contacting with the photosensitive member drum, connection may not be realized, irregular rotation of a driving roller may occur, or color shift may occur due to irregular conveying of an intermediate transferring body. Moreover, because a relative position with a photosensitive member drum is shifted, the transferability of a toner image may be deteriorated.

Furthermore, at the time of setting a positioning member 331 for the body of an image forming apparatus of the intermediate-transferring-body unit 309 to a frame 301 of the image forming apparatus as shown in FIG. 13, a high stiffness is required for the frame 301. However, because a large opening is formed on the frame 301 in order to set or remove process cartridges of four colors, intermediate-transferring-body unit 309, and other replaceable units to or from the frame 301, the stiffness of the frame 301 on which the large opening is formed is greatly deteriorated.

Therefore, the positional accuracy is deteriorated due to not only deterioration of the dimensional accuracies of the above component but also deformation of the frame 301 because of insufficient stiffness. Moreover, at the time of minimizing the plate thickness of the frame 301 in order to decrease the body of the image forming apparatus in weight and cost, the flatness of the frame is deteriorated and thereby, the positional accuracy of the intermediate-transferring-body unit 309 is more remarkably deteriorated.

SUMMARY OF THE INVENTION

It is an object of the present invention to provide an image forming apparatus for forming a high-quality color image by improving the positional accuracy of a conveying unit while improving the operability of the apparatus.

It is another object of the present invention to provide an image forming apparatus comprising a conveying member for conveying a toner image, driving means for driving the conveying member, a first transmitting portion and a second transmitting portion for respectively transmitting the driving force supplied from the driving means to the conveying member, a conveying unit having the conveying member and the first conveying portion, a driving frame for supporting the second transmitting portion, and an apparatus-body frame for supporting the driving frame, in which the conveying unit is mountable to or removable from the apparatus body, the first transmitting portion and the second transmitting portion engage each other or are removed from each other when the conveying unit is mounted to or removed from the apparatus body respectively, and the driving frame has a positioning portion for positioning the conveying unit.

Other objects of the present invention will become more apparent from the following description.

DESCRIPTION OF THE PREFERRED EMBODIMENTS

The preferred embodiment of the present invention will be described below in detail by referring to the accompanying drawings.

Figure 1:
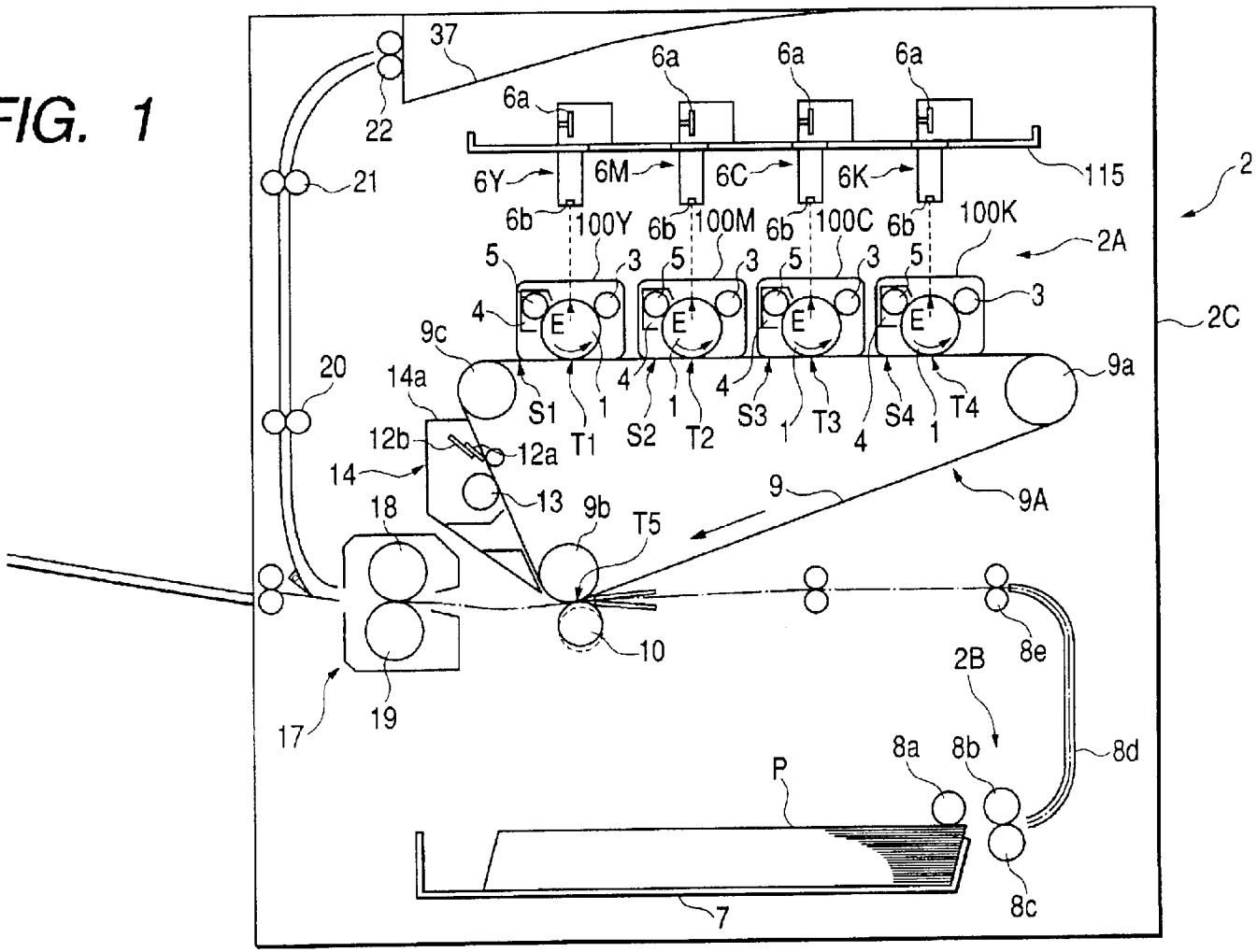
FIG. 1 is an illustration showing an image forming apparatus (color laser printer), which is an embodiment of the present invention.

FIG. 1 is an illustration showing a schematic configuration of a color laser printer that is an image forming apparatus of the embodiment of the present invention.

In FIG. 1, reference numeral 2 denotes a color laser printer. The color laser printer 2 is provided with an image forming portion 2A constituted by process cartridges 100 (100Y, 100M, 100C, and 100K) of colors of yellow (Y), magenta (M), cyan (C), and black (B) respectively having a photosensitive member drum 1 serving as an image bearing body rotating at a constant speed, a developing device 4 and charging means 3, and an intermediate-transferring-body unit 9A having an intermediate transferring body 9 serving as a toner-image conveying member for multiple-transferring toner images of various colors formed in the image forming portion 2A, holding the multiple-transferred color images, and further transferring the multiple-transferred color images to a transferring material P which is a recording material fed from a feeding portion 2B.

In this case, the process cartridges 100 of various colors are detachably mounted to the body of a color laser printer body (hereafter referred to as printer body) 2C so that a unit can be easily replaced in accordance with the service life of the photosensitive member drum 1. In the case of this embodiment, the photosensitive member drum 1 is constituted by applying an organic-photoconductor layer to the outside of an aluminum cylinder and can rotate counter-clockwise in accordance with the image forming operation by a drum motor set to a driving unit to be described later. Moreover, the charging means 3 uniformly charges the surface of the photosensitive member drum 1 in accordance with an injection charging method.

Moreover, the developing device 4 changes an electrostatic latent image formed in accordance with exposure from scanner portions 6 (6Y, 6M, 6C, and 6K) to be described later to the photosensitive member drum 1 to a visible image so as to form a visible image of toners of various colors by sleeves 5 arranged on the photosensitive member drum 1 at very small intervals.

In the case of this embodiment, each of developing devices 4 of various colors feeds the toner in a vessel by a feed mechanism, applies the powder obtained by mixing toner (nonmagnetic) and developer (magnetic) to the periphery of the sleeves 5 and then performs toner development by relating the toner in the powder to an electrostatic latent image of the photosensitive member drum 1.

Moreover, in FIG. 1, reference numeral 6 (6Y, 6M, 6C, and 6K) denotes a scanner unit serving as a scanner portion provided with a not-illustrated laser diode and a polygon mirror 6*a*. When an image signal is supplied, the scanner portion 6 emits image light corresponding to the image signal to the polygon mirror 6*a* by the laser diode. In this case, the polygon mirror 6*a* is rotated at a high speed by a scanner motor. The image light which is emitted by a laser diode and then reflected from the polygon mirror 6*a* selectively exposes the surface of the photosensitive member drum 1 rotating at a constant speed through an imaging lens 6*b* so that an electrostatic latent image is resultantly formed on the photosensitive member drum. Reference numeral 115 denotes a support member for supporting the scanner units 6Y, 6M, 6C, and 6K.

On the other hand, the intermediate-transferring-body unit 9A is detachably mounted to the printer body 2C. Moreover, the intermediate transferring body 9 provided for the intermediate-transferring-body unit 9A rotates clockwise synchronously with the peripheral speed of the photosensitive member drum 1 in order to multiple-transfer a toner image on the photosensitive member drum 1 visualized by each developing device 4 when forming a color image. Moreover, the intermediate transferring body 9 undergoing multiple transfer simultaneously multiple-transfers toner images of various colors on the intermediate transferring body to the transferring material P by conveying the transferring material P while holding the transferring material P together with a secondary transferring roller 10 to which a voltage is applied.

In the case of this embodiment, the intermediate transferring body 9 is formed by a resin belt having a circumferential length of approx. 1,000 mm and suspended with a tension over such three axes as a driving roller 9*a*, secondary-transfer opposite roller 9*b*, and tension roller 9*c*. Moreover, the intermediate transferring body 9 is supported by the printer body 2C by using the driving roller 9*a* as a fulcrum so as to rotate clockwise in accordance with the image forming operation because a driving force is transferred to the driving roller 9*a* from the driving motor of the driving unit.

Moreover, the secondary transferring roller 10 constituting a secondary transferring portion for simultaneously multiple-transferring toner images of various colors on the intermediate transferring body to the transferring material P is detachably mounted to the intermediate transferring body 9, which is constituted by winding a middle-resistance foamed elastic body on a metallic shaft, is vertically movable, and has a driving force.

In this case, the secondary transferring roller 10 is separated from the intermediate transferring body 9 as shown by a broken line so as not to disorder toner images on the intermediate transferring body 9 while toner images of four colors are formed on the intermediate transferring body 9, before the toner images on the intermediate transferring body 9 reach the secondary transferring portion. Then, secondary transferring roller 10 is moved to an upper position shown by a continuous line where the intermediate transferring body 9 is pressed at a predetermined pressure through the transferring material P by a not-illustrated cam member.

Then, by pressing the intermediate transferring body 9 as described above, a bias voltage is simultaneously applied. Thereby, toner images on the intermediate transferring body 9 are transferred to the transferring material P. In this case, because the intermediate transferring body 9 and the secondary transferring roller 10 are respectively driven, the transferring material P held between both undergoes a transferring step, and at the same time, is conveyed in the illustrated left direction at a predetermined speed, and sent toward a fixing device 17 for fixing the toner images formed on the transferring material P to the transferring material P.

In this case, the fixing portion 17 is constituted by a fixing roller 18 for adding heat to the transferring material P and a pressure roller 9 for pressure-welding the transferring material P to the fixing roller 18 so as to convey the transferring material P while heating and pressurizing the transferring material P by rotating rollers 18 and 19 which are hollow rollers and which respectively have a not-illustrated built-in heater.

Thereby, in the fixing device 17 the transferring material P holding toner images is conveyed by the fixing roller 18 and pressure roller 19 and heated and pressurized and resultantly, toner images are fixed to the transferring material P.

On the other hand, the sheet feeding portion 2B for feeding the transferring material P to the image forming portion 2A is provided with a cassette 7 storing a plurality of transferring material sheets P, a pickup roller 8*a*, a feeding roller 8*b*, a retard roller 8*c* for preventing duplicate feed, a sheet-feeding guide plate 8*d*, and a registration roller 8*e*.

Moreover, the pickup roller 8*a* rotates in accordance with the image forming operation when an image is formed to separate and feed the transferring material sheets P in the cassette 7 one by one and the transferring material sheets P reach the registration roller 8*e* via the guide plate 8*d* by the feeding roller 8*b*. Then, the registration roller 8*e* performs the non-rotational operation for making the transferring material P stop and wait under the image forming operation and the rotational operation for conveying the transferring material P toward the intermediate transferring body 9 in accordance with a predetermined sequence and aligns a toner image with the transferring material P in a transferring step which is the next step.

Moreover, reference numeral 14 denotes an intermediate-transferring-body cleaning unit. The intermediate-transferring-body cleaning unit 14 is constituted by a cleaning blade 12*a*, a pressure spring 12*b* for pressing the cleaning blade 12*a* against the intermediate transferring body 9, a fur brush 13, and a cleaner vessel 14*a* for holding the blade 12*a*, spring 12*b*, and brush 13.

The image forming operation of the color laser printer 2 thus constituted will be described below.

When the image forming operation is started, the pickup roller 8*a* rotates and one of the transferring material sheets P in the cassette 7 is separated and the separated transferring material sheet 7 is conveyed to the registration roller 8*e*. On the other hand, the photosensitive member drum 1 and the intermediate transferring body 9 respectively rotate at a predetermined peripheral speed V in the direction of an arrow.

Then, when an optional point on the periphery of the intermediate transferring body 9 comes to a predetermined position shown by S (S1, S2, S3, or S4), the photosensitive member drum 1 whose surface is uniformly charged by the charging means 3 is exposed by a laser beam at the exposure position shown by E to form an image. The distance from the exposure position E of the photosensitive member drum 1 up to the contact portion (primary transferring portion) T (T1, T2, T3, or T4) with the intermediate transferring body 9 counterclockwise is equal to the distance from the point S of the intermediate transferring body 9 up to the point T. Therefore, the point E that is a start point for writing an image coincides with the point S on the intermediate transferring body 9 at the position of the point T. That is, the image is formed clockwise by using the intermediate transferring body 9 corresponding to the point S as a front end.

In the case of this embodiment, a yellow image is primary-transferred to the periphery of the intermediate transferring body 9 as described below. That is, the yellow image is irradiated with a laser beam by the scanner portion 6Y to form a yellow latent image on the photosensitive member drum 1. The developing device 4 is driven simultaneously with formation of the latent image to develop yellow by applying a voltage having the same polarity and an approximately equal potential as those of the photosensitive member drum 1 to the sleeve 5 so that yellow toner attaches to the latent image on the photosensitive member drum 1. At the same time, the yellow toner image on the photosensitive member drum 1 is primary-transferred to the periphery of the intermediate transferring body 9 at the primary transferring position T1 slightly downstream from the developing device 4. In this case, a voltage having a polarity opposite to that of the yellow toner is applied to the intermediate transferring body 9 by transferring means 70 (refer to FIG. 4) and thereby, the yellow toner image is primary-transferred to the intermediate transferring body 9.

Then, when one point on the periphery of the intermediate transferring body 9, that is, the front end of the yellow image, comes to the position of S2, laser-beam irradiation to a magenta image is started by the scanner portion 6M and a latent image is formed on the photosensitive member drum 1 similarly to the case of yellow and the latent image is developed by magenta toner. Thereafter, the magenta toner image on the photosensitive member drum 1 thus developed is transferred onto the yellow toner image on the intermediate transferring body 9 at the primary transferring position T2.

Then, when one point on the periphery of the intermediate transferring body 9, that is, front ends of the yellow and magenta images come to the position of S3, laser-beam irradiation to a cyan image is started by the scanner portion 6C and a latent image is formed on the photosensitive member drum 1 and the latent image is developed by cyan toner. Thereafter, the cyan toner image on the photosensitive member drum 1 thus developed is transferred onto the yellow and magenta toner images on the intermediate transferring body 9 at the primary transferring position T3.

Then, when one point on the periphery of the intermediate transferring body 9, that is, front ends of yellow, magenta, and cyan images come to the position of S4, laser-beam irradiation to a block image is started by the scanner portion 6K and a latent image is formed on the photosensitive member drum 1 and the latent image is developed by black toner. Then, the black toner image on the photosensitive member drum 1 thus developed is transferred onto the yellow, magenta, and cyan toner images on the intermediate transferring body 9 at the primary transferring position T4.

Thus, latent images are formed and developed in order of yellow, magenta, cyan, and black and then, toner-transferred to the intermediate transferring body 9 at primary positions T1, T2, T3, and T4, and a full-color image formed by four types of toners such as yellow, magenta, cyan, and black on the surface of the intermediate transferring body 9.

Then, before primary transfer of the black toner image of the fourth color is completed and the image front end corresponding to the point S1 of the intermediate transferring body 9 on which the full color image is formed reaches a secondary transferring portion T5, conveying of the transferring material P waiting at the registration roller 8*e* is started by adjusting the timing.

Moreover, the full-color image on the intermediate transferring body 9 is transferred to the transferring material P by simultaneously moving the secondary transferring roller 10 waiting below the full-color image of four colors when the image is formed and not contacting with the intermediate transferring body 9 upward by a not-illustrated cam, holding the transferring material P by the secondary transferring portion T5 together with the intermediate transferring body 9, and simultaneously applying a bias having a characteristic opposite to that of toner to the secondary transferring roller 10.

Then, the transferring material P to which the image is transferred at the secondary transferring portion T2 is separated from the intermediate transferring body 9 and conveyed to the fixing portion 17. Then, the transferring material P is toner-fixed at the fixing portion 17 and ejected onto an ejecting tray 37 at the upper portion of the printer body through ejecting rollers 20, 21, and 22 by turning the image surface downward. Thereby, the image forming operation is completed.

Figure 2:
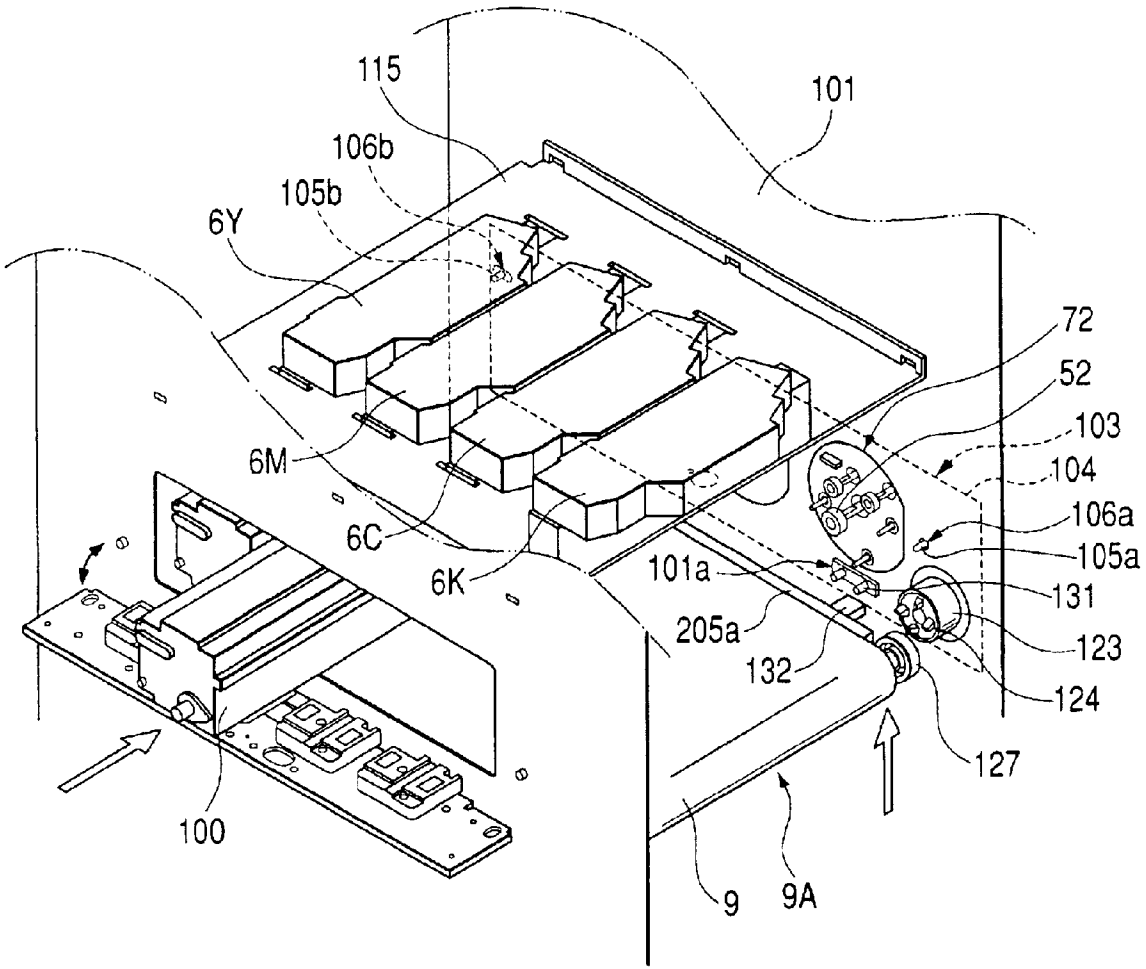
FIG. 2 is an illustration showing a state of setting a process cartridge to a body of a printer.

As described above, the process cartridge 100 is detachably mounted to the printer body 2C. FIG. 2 is an illustration showing a state of setting the process cartridge 100 to the printer body 2C.

In this case, a not-illustrated guide rail portion for moving the process cartridge 100 along the removing direction shown by an arrow is formed in the printer body and a user inserts the process cartridge 100 along the guide rail portion. Moreover, a not-illustrated guide rail portion, formed for removing and changing the intermediate-transferring-body unit 9A along the direction orthogonal to the removing direction of the process cartridge 100, is formed at the inside of the front and rear plates of the printer body and a user sets the intermediate transferring unit 9A in the printer body along the guide rail portion.

Moreover, four photosensitive member drums 1 and a driving unit 103 for driving the intermediate transferring body 9A are positioned and fixed at the back of a rear plate 101 serving as the frame of the printer body 2C located at the inner part in the inserting direction of the process cartridge 100 of the printer body 2C. The driving unit has means for driving the process cartridge and holds and positions the process cartridge.

Figure 3:
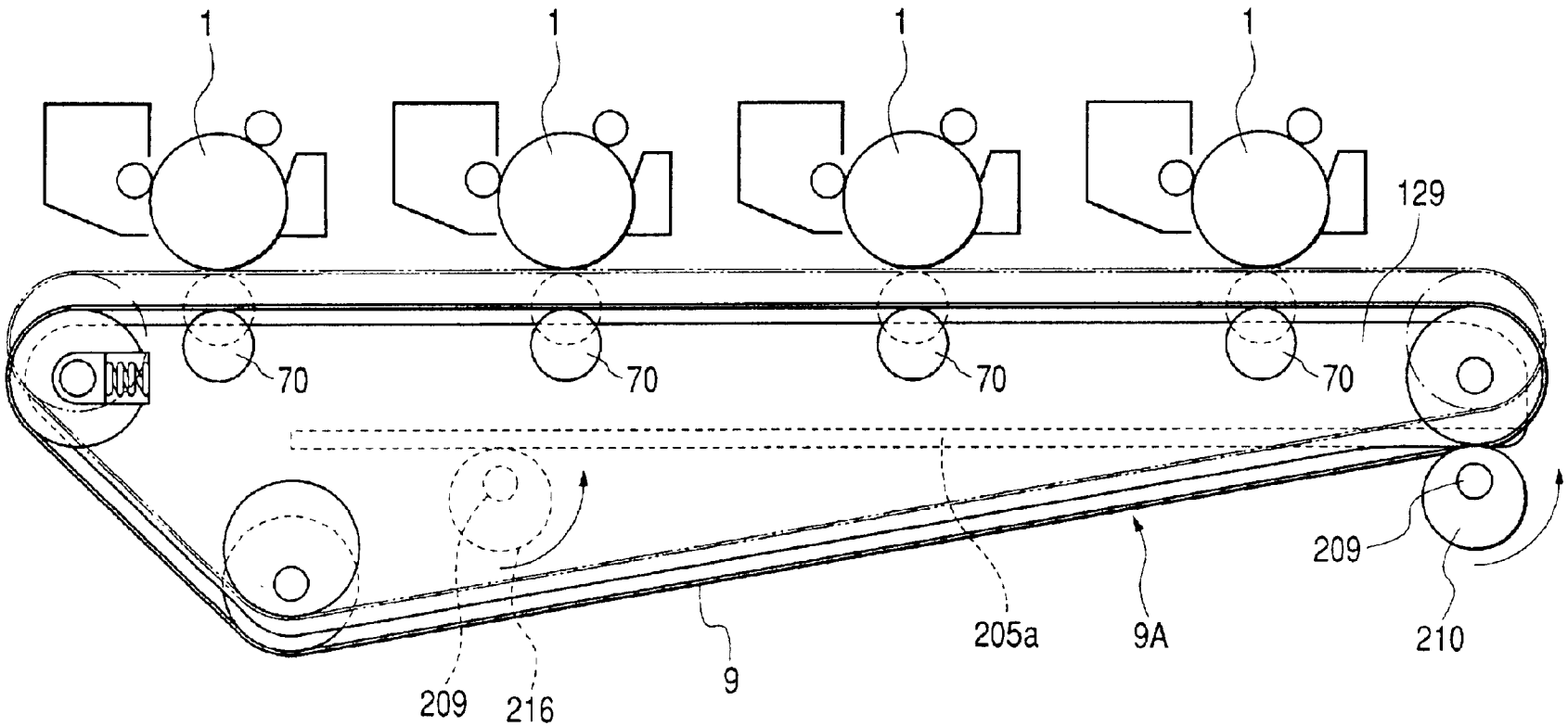
FIG. 3 is an illustration showing an elevating mechanism of an intermediate transferring unit.

FIG. 3 is an illustration showing an elevating mechanism of the intermediate-transferring-body unit 9A. In FIG. 3, an object shown by a continuous line shows a state in which the intermediate transferring body 9 of the intermediate-transferring-body unit 9A is separated from the photosensitive member drum 1.

In this case, this elevating mechanism is provided with eccentric cams 210 and 216 fixed to an eccentric cam shaft 209 and the eccentric cams 210 and 216 are respectively constituted so as to perform the same rotating operation by a not-illustrated link mechanism. Moreover, the eccentric cams 210 and 216 rotate by 180° when a user sets the process cartridge 100 and intermediate-transferring-body unit 9A to the printer body 2C and then rotate a not-illustrated contacting-separating lever to raise an eccentric-cam receiving portion 205*a* formed on a frame 129 of the intermediate-transferring-body unit 9A.

Figure 4:
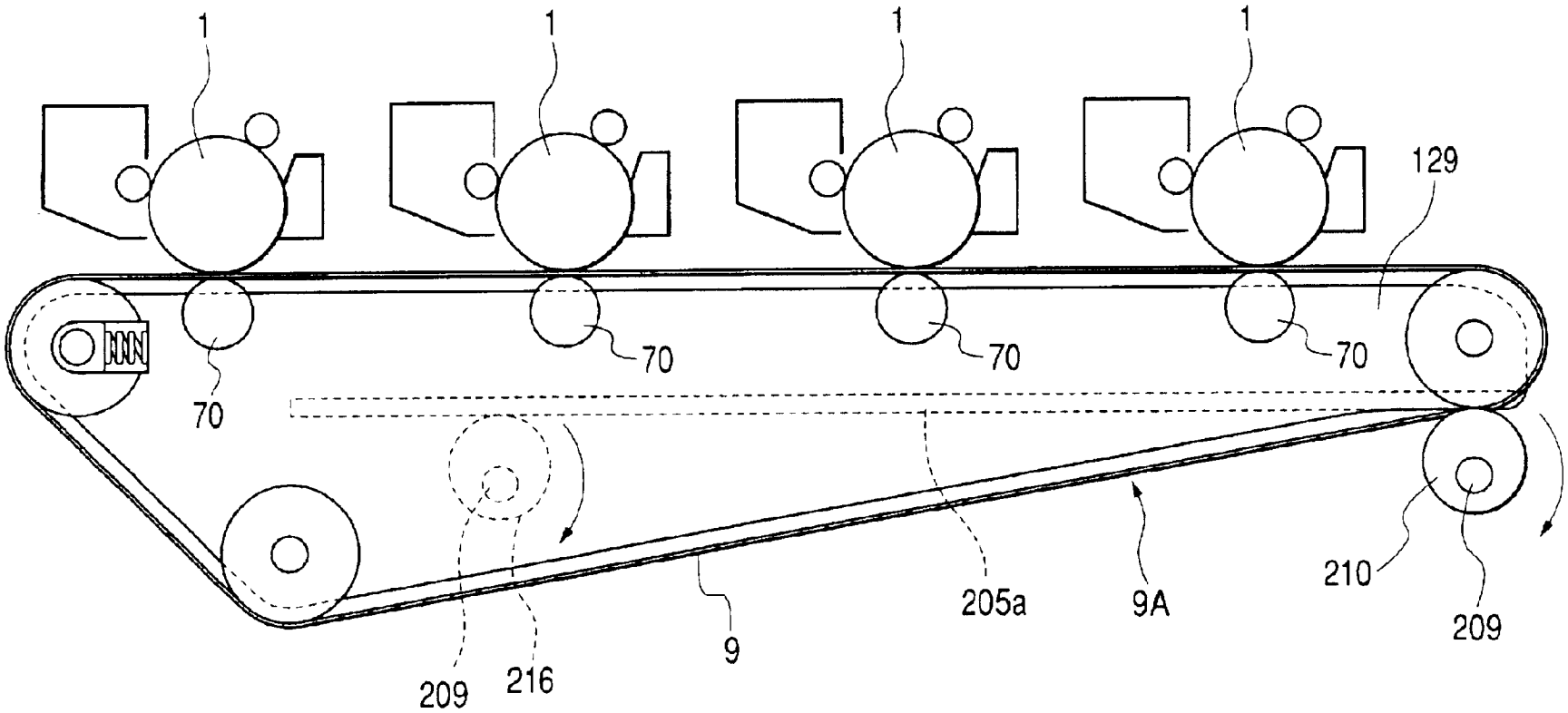
FIG. 4 is an illustration showing a state in which an intermediate transferring unit rises up to a position where the unit contacts a photosensitive member drum.

Thereby, as shown in FIG. 4, the intermediate-transferring-body unit 9A rises almost in parallel and as a result, the intermediate transferring body 9 contacts with the photosensitive member drum 1. When the intermediate-transferring-body unit 9A rises as described above, the intermediate-transferring-body unit 9A is driving-connected with the driving unit 103.

Then, the driving unit 103 will be described below which drives the photosensitive member drum 1 and intermediate transferring body 9.

Figure 5:
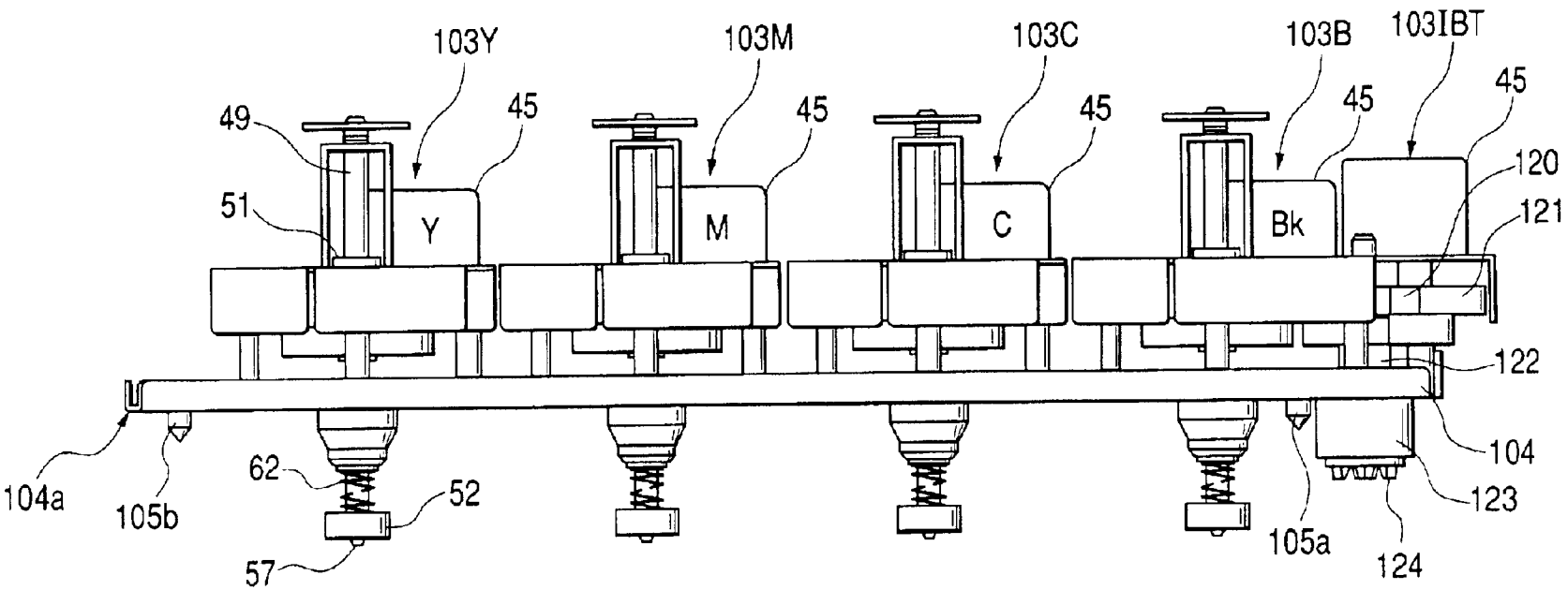
FIG. 5 is a top view showing a configuration of a driving unit.

As shown in FIG. 5, the driving unit 103 is provided with driving portions 103Y, 103M, 103C, and 103B for driving photosensitive member drums 1 of colors Y, M, C, and B and a driving portion 103ITB for driving the intermediate transferring body 9 and these driving portions 103Y, 103M, 103C, 103B, and 103ITB are respectively accurately positioned and fixed on a frame of the driving unit 103 (hereafter referred to as driving frame) 104. The driving frame 104 is formed by a sheet metal thicker than the body rear plate 101 and has a shape whose stiffness is larger (stronger) than that of the body rear plate 101 by forming a bent portion 104*a* on the frame 104.

Figure 6:
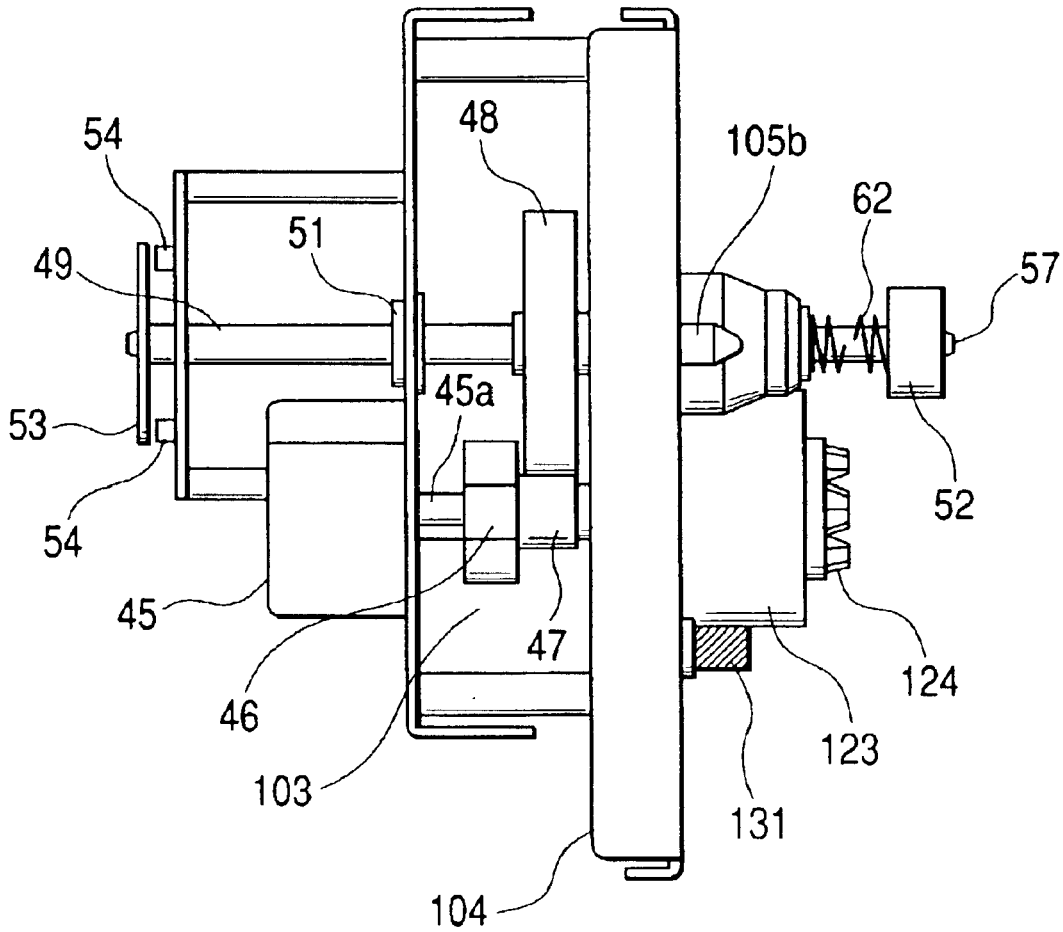
FIG. 6 is a side view showing a configuration of a driving portion for driving a photosensitive member drum of the driving unit.
Figure 7:
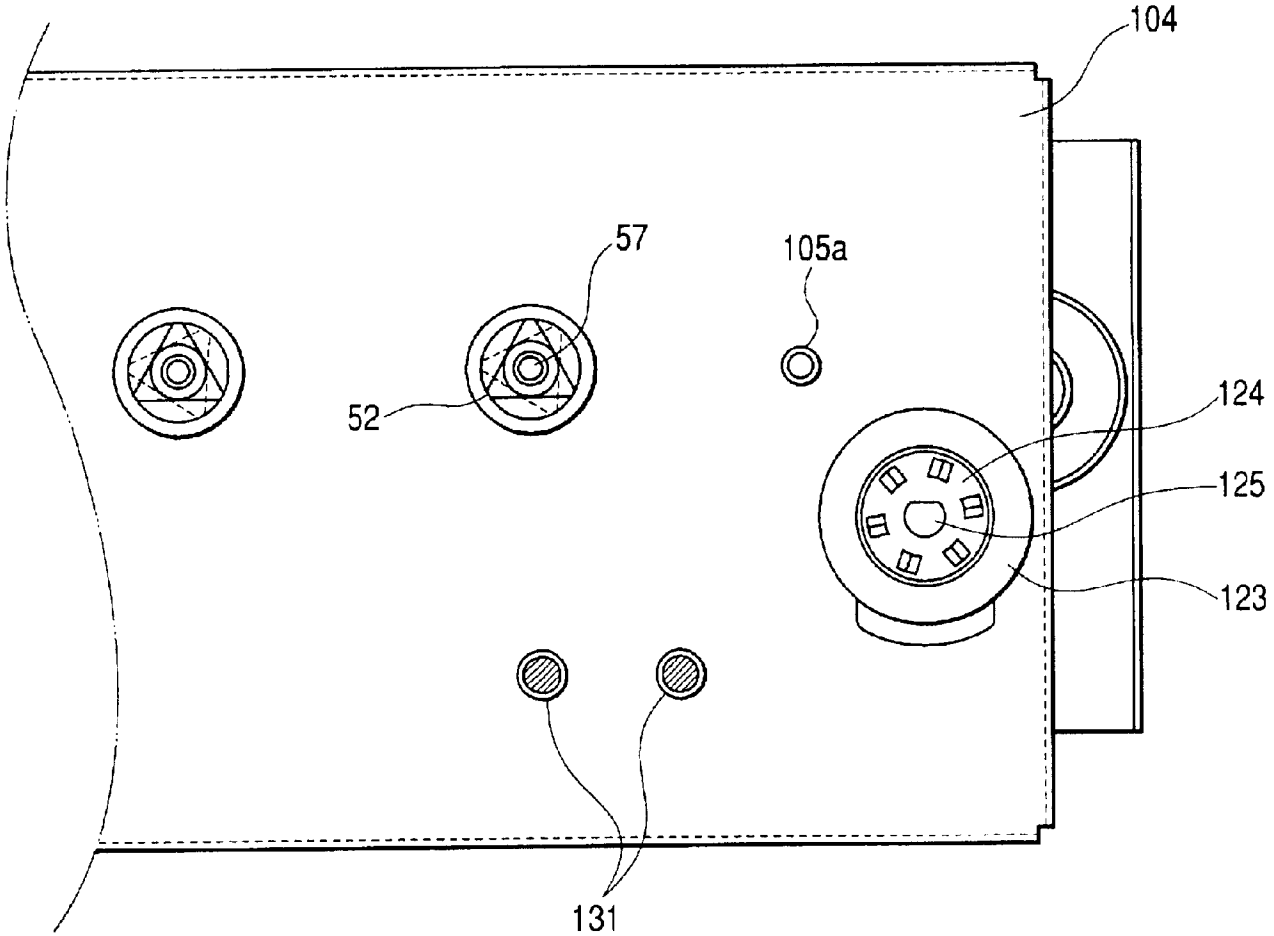
FIG. 7 is a front view showing a configuration of the driving unit.

In this case, as shown in FIG. 6, the driving portions 103Y, 103M, 103C, and 103B for various colors are respectively provided with a fixed motor 45, a pinion 46 fixed to a motor shaft 45*a* of the motor 45, a large gear 48 fixed to a drum driving shaft 49, an intermediate gear 47 engaged with the pinion 46 and large gear 48, an almost-spherical positioning portion 57 formed at the front end of the drum driving shaft 49, a bearing 51 for supporting the drum driving shaft 49 so as not to move in the shaft direction, and a triangular coupling 52 shown in FIG. 7.

Moreover, as shown in FIG. 6, a rotary encoder 53 is set to the opposite end of the drum driving shaft 49 and moreover, two rotation detecting means 54 for detecting the rotational fluctuation of the drum driving shaft 49 by the rotary encoder 53 are accurately set to positions opposite to each other by 180° about the drum driving shaft 49. Furthermore, it is possible to minimize the rotational fluctuation of the drum driving shaft 49 for each color by detecting the rotational fluctuation of one turn of the photosensitive member drum 1 by these rotation detecting means 54 and controlling the next rotation of the drum motor 45 in accordance with a driving signal for canceling the rotational fluctuation of one turn of the photosensitive member drum 1.

Figure 8:
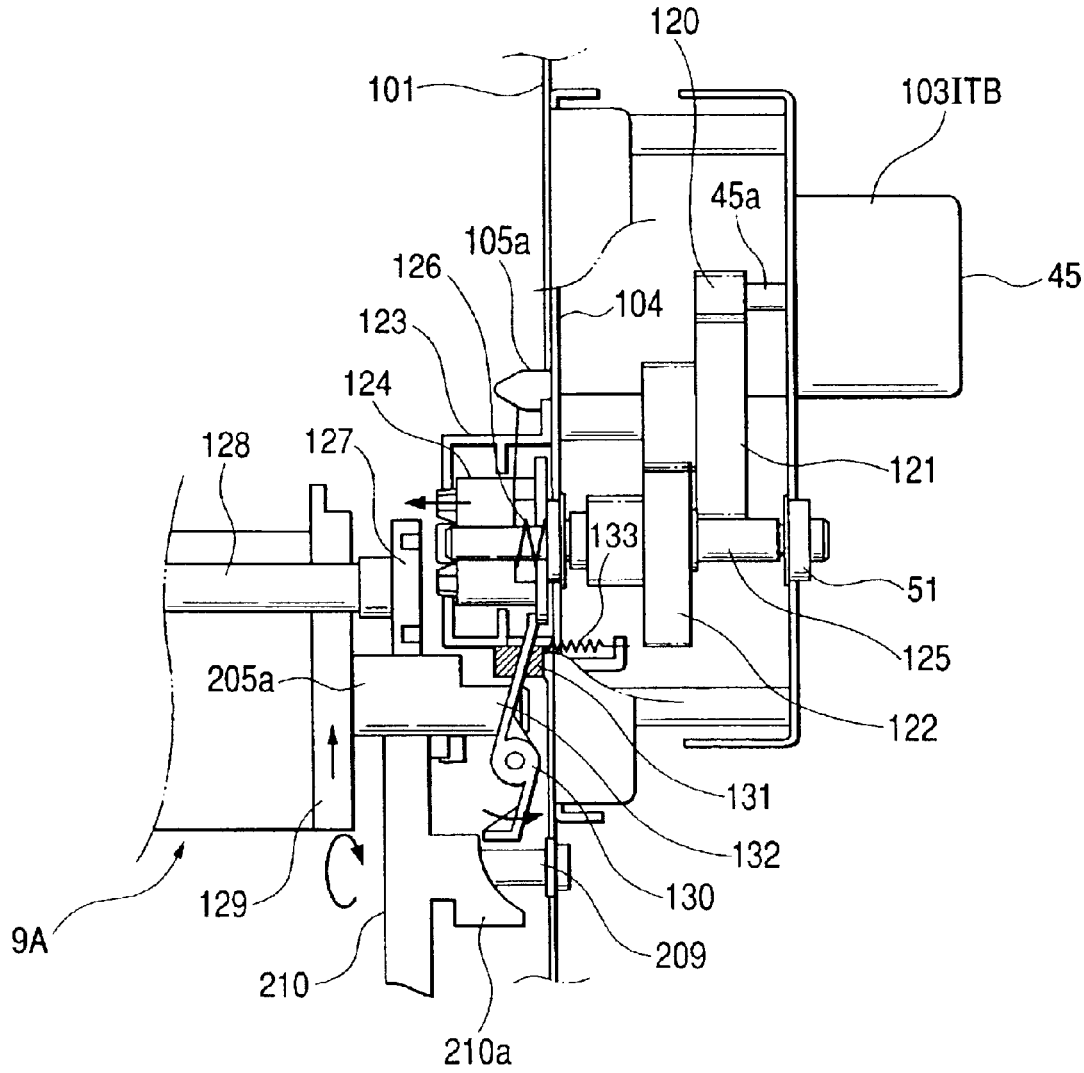
FIG. 8 is a side view showing a configuration of a driving portion for driving an intermediate-transferring-body unit of the driving unit.

On the other hand, as shown in FIG. 8, the intermediate-transferring-body-unit driving portion 103ITB is provided with a fixed motor 45 serving as driving means for driving an intermediate transferring body 9, a pinion 120 fixed to a motor shaft 45*a*, a large gear 122 fixed to a driving shaft 125, an intermediate gear 121 engaged with the pinion 120 and a large gear 122, a bearing 51 for supporting the driving shaft 125 so as not to move in the shaft direction, and a driving coupling 124 serving as a second driving transmitting portion for transmitting the driving of the motor 45 to the intermediate-transferring-body unit 9A (intermediate transferring body 9).

In this case, the driving coupling 124 is supported so as to be movable in the thrust direction along the driving shaft 125 in a coupling holder 123 and urged in the intermediate-transferring-body direction by a return spring 126.

In FIG. 8, reference numeral 130 denotes a rotatable connection cancel lever for canceling the connection between the driving coupling 124 and a coupling 127 of the intermediate-transferring-body unit 9A serving as a first driving transmitting portion and 133 denotes a cancel spring having an urging force larger than that of the return spring 126.

Then, when the intermediate-transferring-body unit 9A (intermediate transferring body 9) is separated from the photosensitive member drum 1, that is, when the eccentric cam 210 is present at the position shown in FIG. 3 already described, the connection cancel lever 130 is rotated clockwise by the cancel spring 133 as shown in FIG. 8 to hold the driving coupling 124 at a withdrawal position for canceling the driving connection with the coupling 127 of the intermediate-transferring-body unit 9A.

On the other hand, as shown in FIG. 8, a convex shape 210*a* is formed on the side face of the eccentric cam 210 and in the separate state of the intermediate-transferring-body unit 9A shown in FIG. 8, the convex shape 210*a* separates from the connection cancel lever 130. Therefore, the connection cancel lever 130 moves to the withdrawal position.

Figure 10:
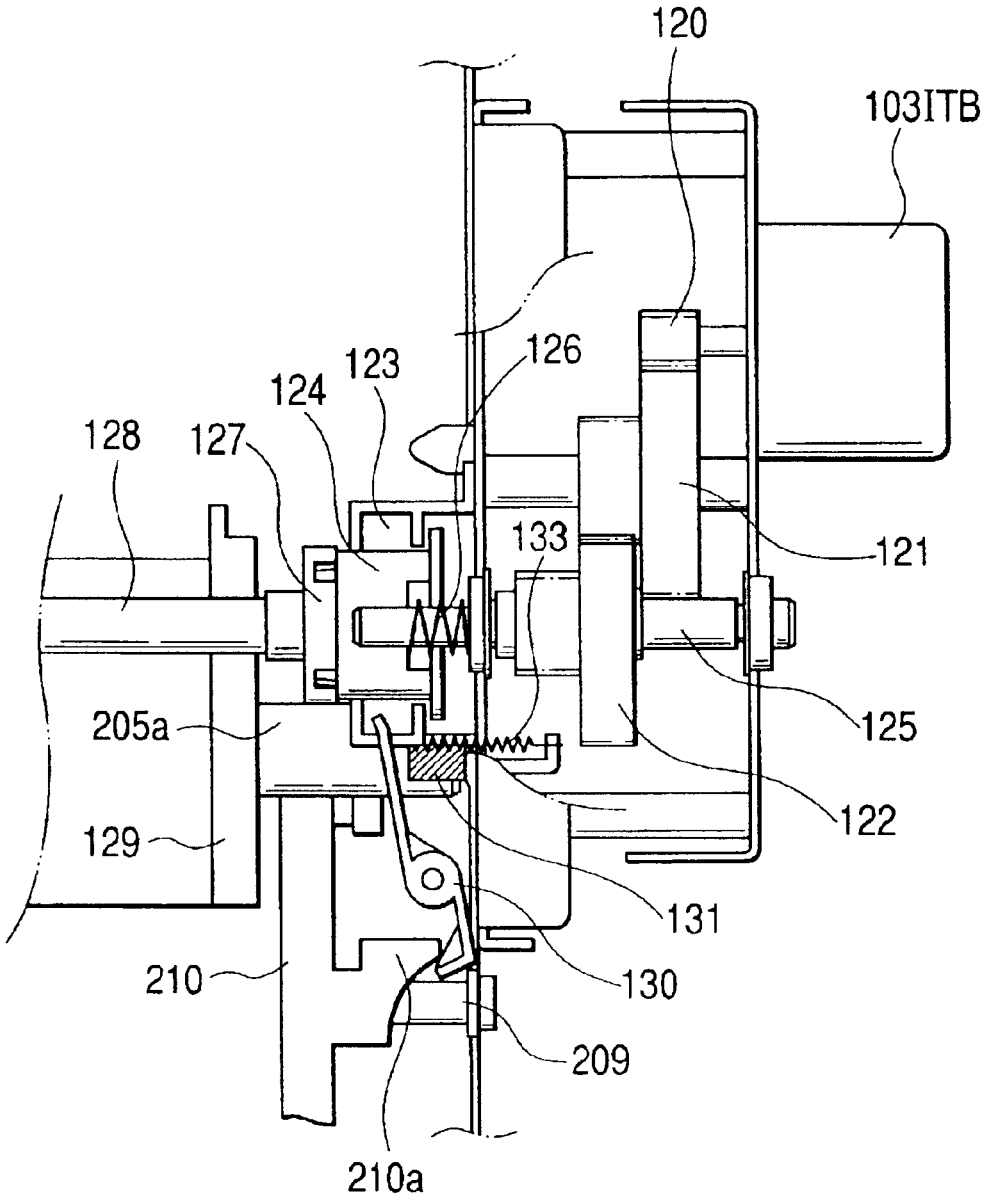
FIG. 10 is a side view for explaining a driving-connecting mechanism for the driving unit and the intermediate-transferring-body unit.
Figure 11:
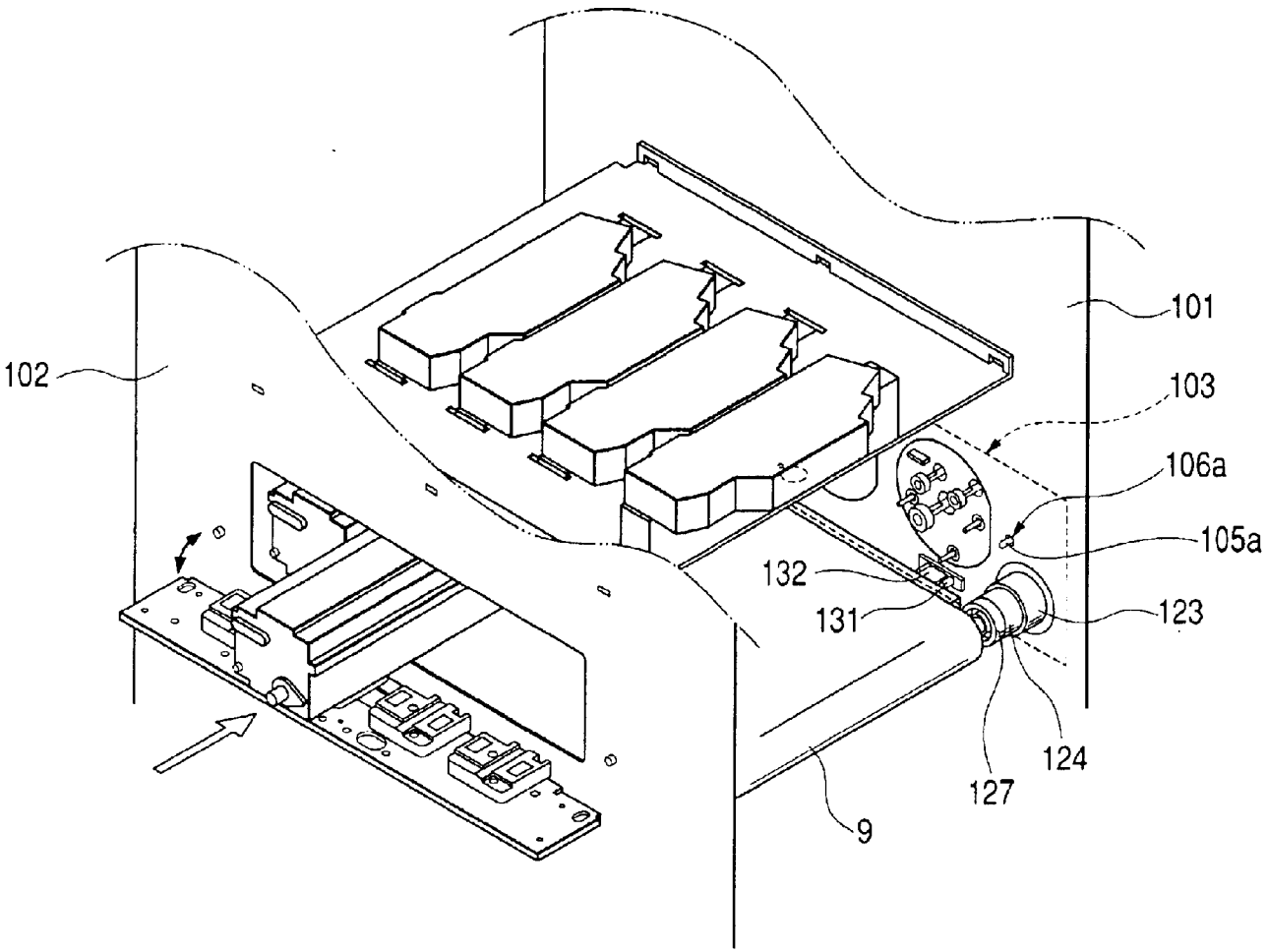
FIG. 11 is a perspective view for explaining the driving-connecting mechanism for the driving unit and the intermediate-transferring-body unit.

As shown in FIG. 10 to be described later, when the eccentric cam 210 rotates, the convex shape 210*a* of the eccentric cam 210 presses the connection cancel lever 130 and thereby, the connection cancel lever 130 rotates counterclockwise by overwhelming the urging force of the cancel spring 123. Moreover, when the connection cancel lever 130 rotates as described above, the driving coupling 124 is released from the inhibiting force of the connection cancel lever 130, slides in the direction of the intermediate-transferring-body unit by the urging force of the return spring 126 along the driving shaft 125, and connects with the coupling 127 of the intermediate-transferring-body unit 9A.

On the other hand, in FIG. 5, reference numeral 105*a* denotes a first positioning pin and 105*b* denotes a second positioning pin which serve as a first positioning portion and a second positioning portion respectively at the time of setting the driving unit 103 to the body rear plate 101. The first positioning pin 105*a* and the second positioning pin 105*b* are fixed to the opposite side to a gear portion on the driving frame 104 at two places and positions of the first positioning pin and the second positioning pin in their height directions (y direction) are the same as central shafts of photosensitive member drums 1 of various colors (that is, present on the same axis y=0).

Moreover, the first positioning pin (first reference axis) 105*a* at the driving portion 1031ITB for driving the intermediate transferring body 9 also serves as the reference (x=0) in x direction (horizontal direction) in the driving frame 104 and the driving unit 103 is fixed to the body rear plate 101 by setscrews on the basis of the first positioning pin 105*a* (refer to FIGS. 7 and 8).

Moreover, in FIG. 7, reference numeral 131 denotes a positioning member serving as a positioning portion for positioning the intermediate-transferring-body unit 9A when the intermediate-transferring-body unit 9A is set to the printer body 2C and the positioning member 131 is accurately set on the driving frame 104 in x- and y-directions on the basis of the first positioning pin 105*a* together with the drum driving shaft 49 for driving the photosensitive member drums 1 of various colors.

In the case of this embodiment, two positioning members 131 are horizontally set to the driving frame 104 while keeping an interval capable of fitting with a positioning-fitting member 132 set on the intermediate transferring frame 129.

Moreover, when the driving unit 103 is fixed to the body rear plate 101 on the basis of the first positioning pin (first reference axis) 105*a*, the positioning member 131 protrudes toward the intermediate-transferring-body unit from an opening 110*a* formed on the body rear plate 101. Moreover, the coupling 52 serving as a part of the driving unit 103 protrudes into the apparatus from the driving unit 103 by passing through an opening 72 of an apparatus body frame 101.

Figure 9:
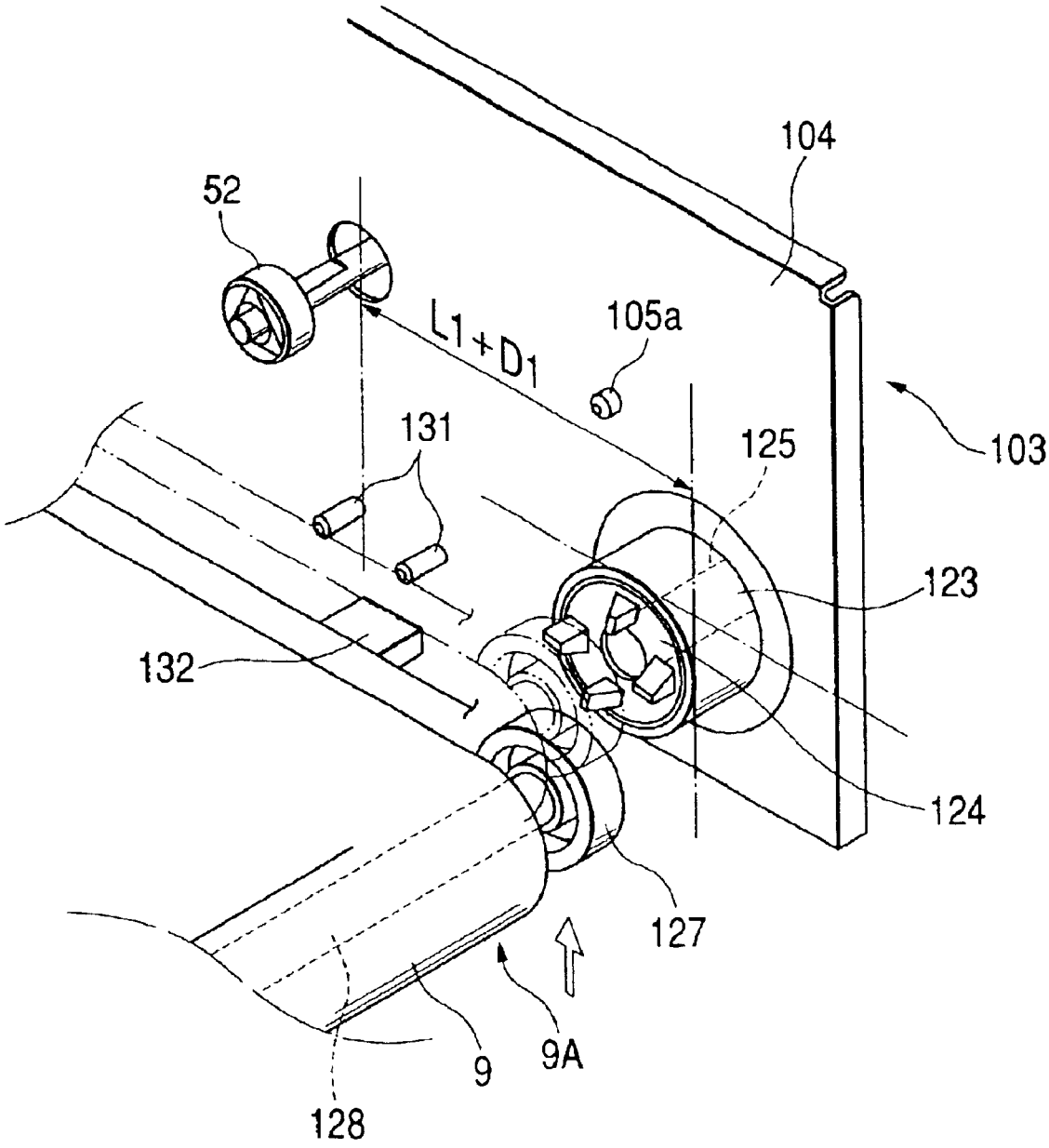
FIG. 9 is a perspective view for explaining a positioning and driving-connecting mechanism for the driving unit and the intermediate-transferring-body unit.

Thus, because the positioning member 131 protrudes toward the intermediate-transferring-body unit, when a user raises the intermediate-transferring-body unit 9A described above, the positioning-fitting member 132 set onto the intermediate transferring frame 129 shown in FIG. 9 accurately fits between two positioning members 131 on the driving frame 104. Thereby, the intermediate-transferring-body unit 9A is accurately positioned to the printer body 2C on the basis of the first positioning pin (first reference axis) 105*a*.

Moreover, in this case, because the driving shaft 125 is accurately set on the driving frame 104 in an x direction on the basis of the positioning member 131, a positional error of the driving connecting portion produced in the driving unit 103 is only a dimensional error D1 of the dimension L1 between the driving shaft 125 and the positioning member 131. The dimensional error D1 can be controlled to approx. 30 $\mu$m when working a sheet metal.

As a result, when the positioning-fitting member 132 fits between the positioning members 131 and the intermediate-transferring-body unit 9A is positioned, it is possible to minimize the horizontal (x-directional) dimensional error between the driving shaft 125 and the central axis of a driving roller shaft 128 of the intermediate-transferring-body unit 9A having the coupling 127 at its front end when both couplings 124 and 127 are connected to each other.

Thus, by accurately setting the intermediate-transferring-body-unit positioning member 131 and the driving shaft 125 that is the center of a driving coupling at a minimum dimensional tolerance capable of forming a sheet metal, it is possible to accurately assure the connection accuracy between the couplings 124 and 127 when the intermediate-transferring-body unit 9A rises.

Thereby, the setting/removing operability of the intermediate-transferring-body unit 9A to or from the printer body 2C is improved, a user can easily perform maintenance, and it is possible to improve the positional accuracy of the intermediate-transferring-body unit 9A. As a result, when the intermediate-transferring-body unit 9A driving-connects with the driving unit 103, connection is not disabled or irregular rotation of the driving roller 9*a* does not occur and thus, it is possible to provide a high-accuracy and high-quality full-color image.

As shown in FIG. 2, reference holes 106 and 106*b* accurately fitting with the first positioning pin 105*a* and the second positioning pin 105*b* of the driving unit 103 are formed on the body rear plate 101. In this case, a center of the reference hole 106*a* fitting with the first positioning pin 105*a* of the driving unit 103 is the origin (x=0, y=0) of the body rear plate 101 and all portions on the body rear plate 101 are formed on the basis of the first reference hole 106*a*.

Moreover, the reference hole 106*a* fits with the first positioning pin 105*a* in both x and y directions to position the driving unit 103. However, the second reference hole 106*b* into which the second positioning pint 105*b* is inserted has a racetrack shape hole extending in the x direction and fitted with the second positioning pin 105*b* and positioned only in the y direction.

Moreover, as already described, by constituting the driving frame 104 by a sheet metal thicker than the body rear plate 101 and forming a bent portion on the driving frame 104 to form a shape having a large stiffness, it is possible to improve the deterioration of the positional accuracy of the intermediate-transferring-body unit 9A due to a body deformation caused by an insufficient stiffness due to deterioration of the flatness of the body rear plate 101.

Then, the driving-connecting operation between the intermediate-transferring-body unit 9A and the driving unit 103 of the color laser printer 2 thus constituted will be described below.

First, as described above, when the user raises the intermediate-transferring-body unit 9A by rotating a not-illustrated contacting/separating lever and bringing the intermediate transferring body 9 into contact with the photosensitive member drum 1, the convex shape 210*a* of the eccentric cam 210 presses the connection cancel lever 130 and thereby, the connection cancel lever 130 rotates counterclockwise by overwhelming the urging force of the cancel spring 133.

Then, when the connection cancel lever 130 thus rotates, the driving coupling 124 is released from the inhibiting force of the connection cancel lever 130, slides in the intermediate-transferring-body unit along the driving shaft 125 in accordance with the urging force of the return spring 126, and connects with the coupling 127 of the intermediate-transferring-body unit 9A.

At the same time as described above, the positioning-fitting member 132 of the intermediate-transferring-body unit 9A accurately fits between the positioning members 131 and the intermediate transferring body 9 is positioned to the printer body 2C.

Thus, it is possible to improve the positional accuracy of the intermediate-transferring-body unit 9A by positioning the intermediate-transferring-body unit 9A by the positioning member 131 formed on the driving frame 104 when the driving coupling 124 connects and engages with the coupling 127 of the intermediate-transferring-body unit 9A in order to set the intermediate-transferring-body unit 9A to the printer body 2C and thereby, it is possible to form a high-quality color image while improving the operability.

Figure 12:
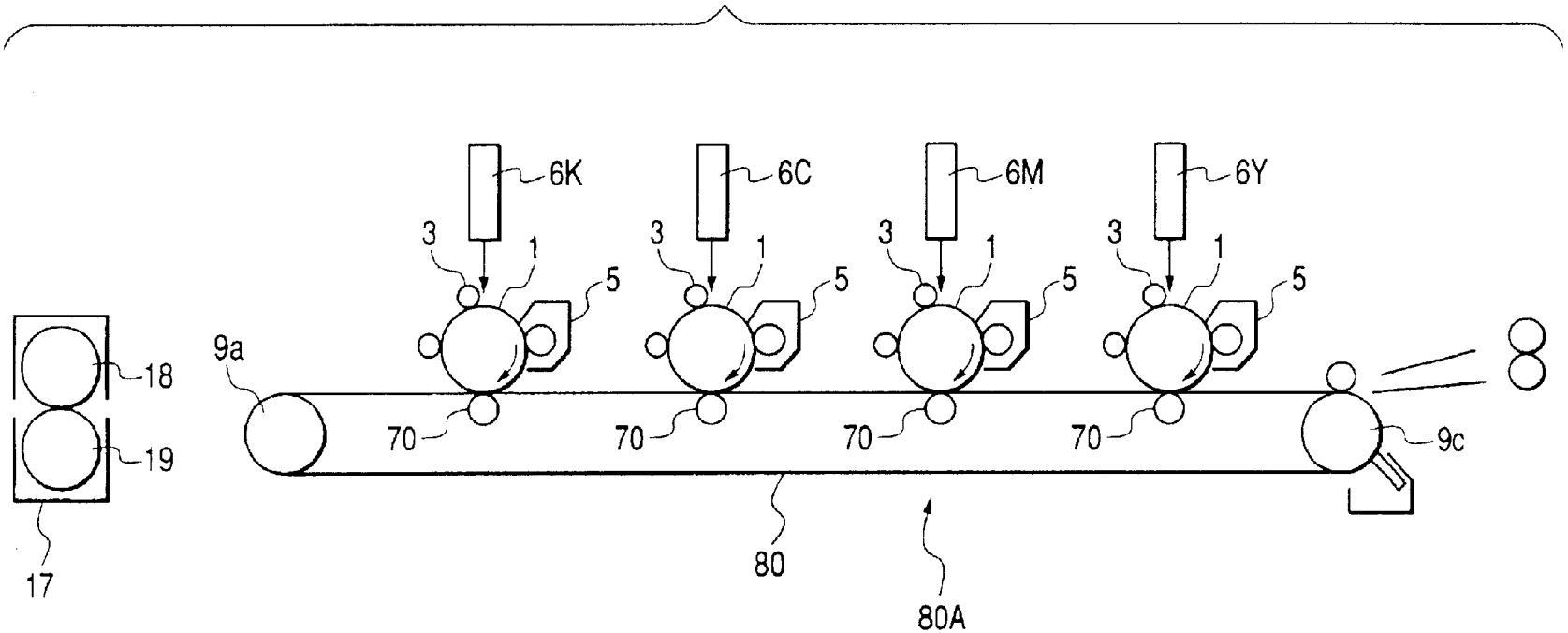
FIG. 12 is an illustration showing another image forming apparatus to which the present invention can be applied.
Figure 13:
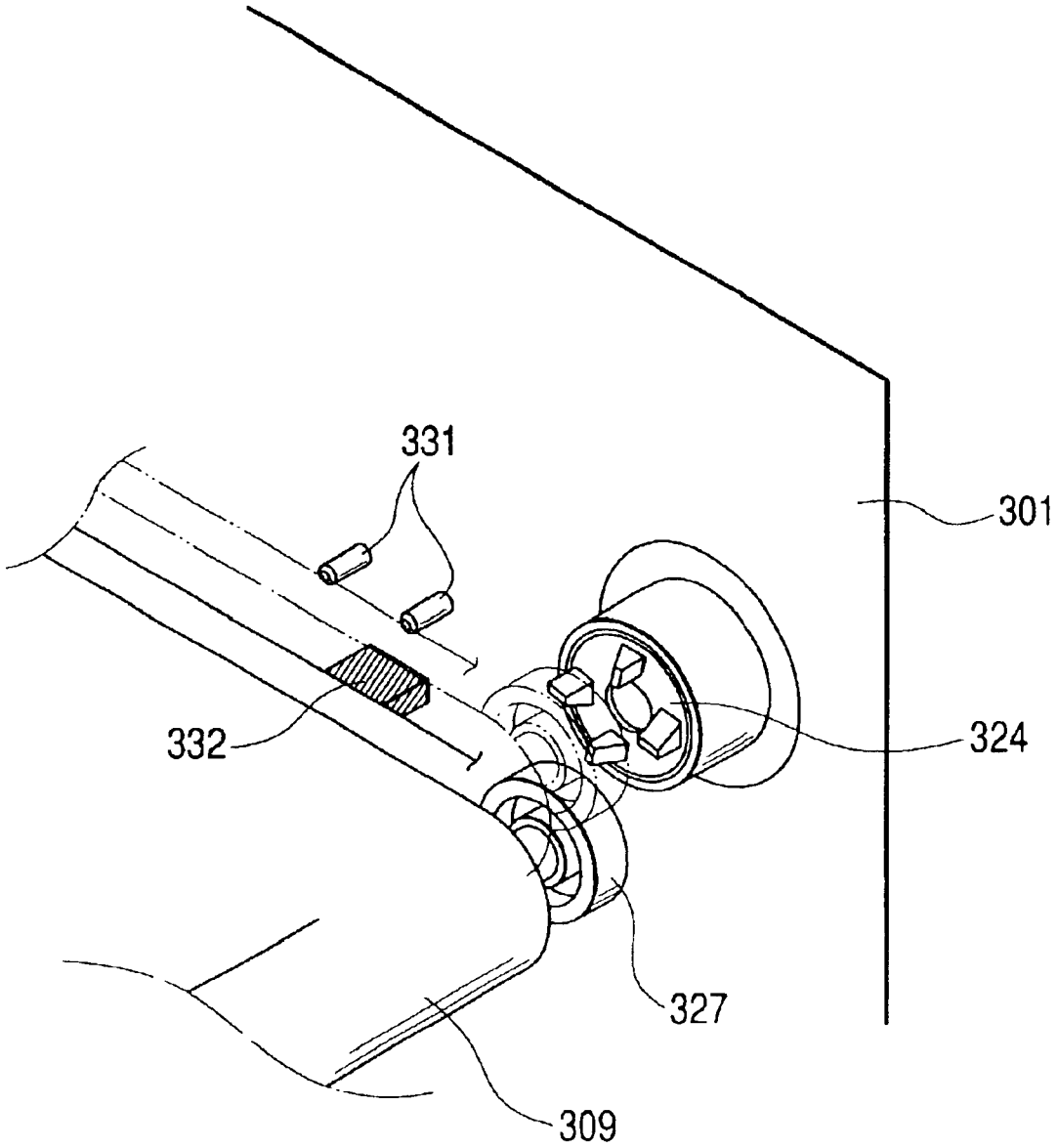
FIG. 13 is a perspective view for explaining a positioning and driving-connecting mechanism for a driving unit and an intermediate-transferring-body unit of a conventional image forming apparatus.

An image forming apparatus is described above which forms a color image on a transferring material by successively transferring toner images of a plurality of colors formed on a plurality of image bearing bodies arranged in parallel to an intermediate transferring body and then simultaneously transferring the toner images of a plurality of colors to a transferring material. However, it is needless to say, as shown in FIG. 12, that the present invention can be applied not only to the above image forming apparatus, but also to an image forming apparatus for successively transferring toner images of a plurality of colors formed on a plurality of image bearing bodies arranged in parallel to a transferring material conveyed by a transferring-material conveying member, in which a unit 80A provided with a conveying member 80 for conveying toner images through the transferring material is detachably mounted to the apparatus body.

As described above, in the case of the present invention, it is possible to engage a first transmitting portion with a second transmitting portion by using the positioning portion of the frame of a driving unit and thereby positioning a conveying unit when forming the positioning portion on the frame of the driving unit, setting a conveying unit, and engaging the first transmitting portion with the second transmitting portion to improve the positional accuracy of the conveying unit. Thus, by improving the positional accuracy of an intermediate-transferring-body unit, it is possible to form a high-quality image while improving the operability.

The embodiment of the present invention is described above. However, the present invention is not restricted to the above embodiment. Any modification is allowed within the technical thought of the present invention.

What is claimed is:

1. An image forming apparatus comprising:

a conveying member for conveying a toner image;

driving means for moving the conveying member;

a first transmitting portion and a second transmitting portion for transmitting a driving force from the driving means to the conveying member;

a conveying unit having the conveying member and the first transmitting portion, wherein the conveying unit is mountable to or removable from a body of the apparatus, and the first transmitting portion engages with the second transmitting portion on a condition that the conveying unit is mounted to the body of the apparatus;

a driving frame for supporting the second transmitting portion; and an apparatus body frame for supporting the driving frame, wherein the driving frame has a positioning portion for positioning the conveying unit.

2. An image forming apparatus according to claim 1, comprising a driving unit having the driving means, the second transmitting portion, and the driving frame.

3. An image forming apparatus according to claim 2, wherein the apparatus body frame has an opening through which a part of the driving unit passes.

4. An image forming apparatus according to claim 1, comprising a scanner unit and a supporting member for supporting the scanner unit, wherein the apparatus body frame supports the supporting member.

5. An image forming apparatus according to claim 1, wherein a stiffness of the driving frame is larger than a stiffness of the apparatus body frame.

6. An image forming apparatus according to claim 1, comprising a process cartridge which can be set to or removed from the body of the apparatus, wherein the process cartridge has an image bearing body for bearing a toner image to be transferred to the conveying member and is driven by the driving unit.

7. An image forming apparatus according to claim 1, comprising an image bearing body for bearing a toner image, wherein the conveying member is an intermediate transferring body to which a toner image on the image bearing body is transferred.

8. An image forming apparatus according to claim 1, comprising an image bearing body for bearing a toner image, wherein the conveying member bears and conveys a transferring material, and wherein a toner image on the image bearing body is transferred to a transferring material on the conveying member.

* * * * *

UNITED STATES PATENT AND TRADEMARK OFFICE

CERTIFICATE OF CORRECTION

PATENT NO. : 6,839,532 B2
DATED : January 4, 2005
INVENTOR(S) : Shigeru Hoashi

It is certified that error appears in the above-identified patent and that said Letters Patent is hereby corrected as shown below:

Title page,
Item [56], References Cited, U.S. PATENT DOCUMENTS, please insert -- 6,324,355 11/2001 Matsui et al. 399/38 --; "2001187399" should read -- 2001-187399 --; and "20022287455" should read -- 2002-287455 --.

Column 2,
Line 6, "to once" should read -- to --.

Signed and Sealed this

Sixth Day of September, 2005

JON W. DUDAS
*Director of the United States Patent and Trademark Office*